United States Patent [19]

Heikkinen

[11] Patent Number: 5,010,981

[45] Date of Patent: Apr. 30, 1991

[54] ELEVATOR MACHINE

[75] Inventor: Urho J. Heikkinen, Espoo, Finland

[73] Assignee: Kone Elevator GmbH, Baar, Switzerland

[21] Appl. No.: 376,478

[22] Filed: Jul. 7, 1989

[30] Foreign Application Priority Data

Jul. 7, 1988 [FI] Finland ..... 883244

[51] Int. Cl.[5] ..... B66B 11/04

[52] U.S. Cl. ..... 187/20; 254/342; 475/323

[58] Field of Search ..... 187/20, 22; 254/342, 254/295; 475/323, 325

[56] References Cited

U.S. PATENT DOCUMENTS

| | | | |
|---|---|---|---|
| 672,013 | 4/1901 | Rydberg | 475/323 |
| 1,293,190 | 2/1919 | Pollard | 475/325 |
| 1,763,600 | 6/1930 | Gilman | 254/342 |
| 2,199,668 | 5/1940 | Lawler | 475/323 |
| 4,355,785 | 10/1982 | Tosato et al. | 187/20 |

FOREIGN PATENT DOCUMENTS

| | | | |
|---|---|---|---|
| 47150 | 10/1929 | Netherlands | 254/295 |

*Primary Examiner*—Robert P. Olszewski
*Assistant Examiner*—Kenneth Noland
*Attorney, Agent, or Firm*—Sughrue, Mion, Zinn, Macpeak & Seas

[57] ABSTRACT

In an elevator machine consisting of a drive motor, a drive shaft driven by the motor, a traction sheave transmitting the motion to the elevator car by means of ropes and a gear assembly to reduce the rotational speed of the motor for the traction sheave, the gear assembly is located inside the traction sheave, the drive shaft passes through the traction sheave, the drive motor is coupled to one end of the drive shaft and the brake is mounted on the other end on the opposite side of the traction sheave.

5 Claims, 2 Drawing Sheets

ELEVATOR MACHINE

BACKGROUND OF THE INVENTION

1. Field Of The Invention

The present invention relates to an elevator machine, more particularly it relates to an elevator machine consisting of a drive motor, a drive shaft driven by the motor, a traction sheave purposed to transmit motion of the drive shaft to an elevator car by means of ropes, and a gear assembly to reduce the rotational speed of the motor for the traction sheave.

2. Description Of Related Art

The commonest type of reduction gear used between the drive motor and traction sheave of an elevator is the worm gear. However, as the worm gear has a relatively low efficiency, there has been a trend towards the use of other types of reduction gear. Worm gears have been replaced e.g. by spur gears, which have a better efficiency, especially at start-up. A disadvantage with currently used spur gears is that the gear assemblies are bulky and therefore impractical.

SUMMARY OF THE INVENTION

An object of the present invention is to create an elevator machine that is more efficient than machines with a worm gear and less bulky than currently used spur gear machines and is therefore easier to install.

In a preferred embodiment of the invention the gear assembly is located inside the traction sheave, the drive shaft passes through the traction sheave, the drive motor is coupled to one end of the drive shaft and a brake is mounted at the other end on the opposite side of the traction sheave.

In another preferred embodiment of the invention the drive shaft is provided with a toothing which is purposed to mesh with one or more intermediate gears mounted with bearings on fixed axles.

In yet another preferred embodiment of the invention the traction sheave is provided with internal toothing purposed to engage at least one intermediate gear.

In still another preferred embodiment of the invention the drive shaft is mounted with bearings inside a supporting axle and the bearings are located in the axial direction on either side of the toothing of the drive shaft.

BRIEF DESCRIPTION OF THE DRAWINGS

Further objects, features and advantages of the invention will become apparent to those skilled in the art from the following description thereof when taken in conjunction with the accompanying drawings, in which.

DESCRIPTION OF THE PREFERRED EMBODIMENTS

Figure 1:
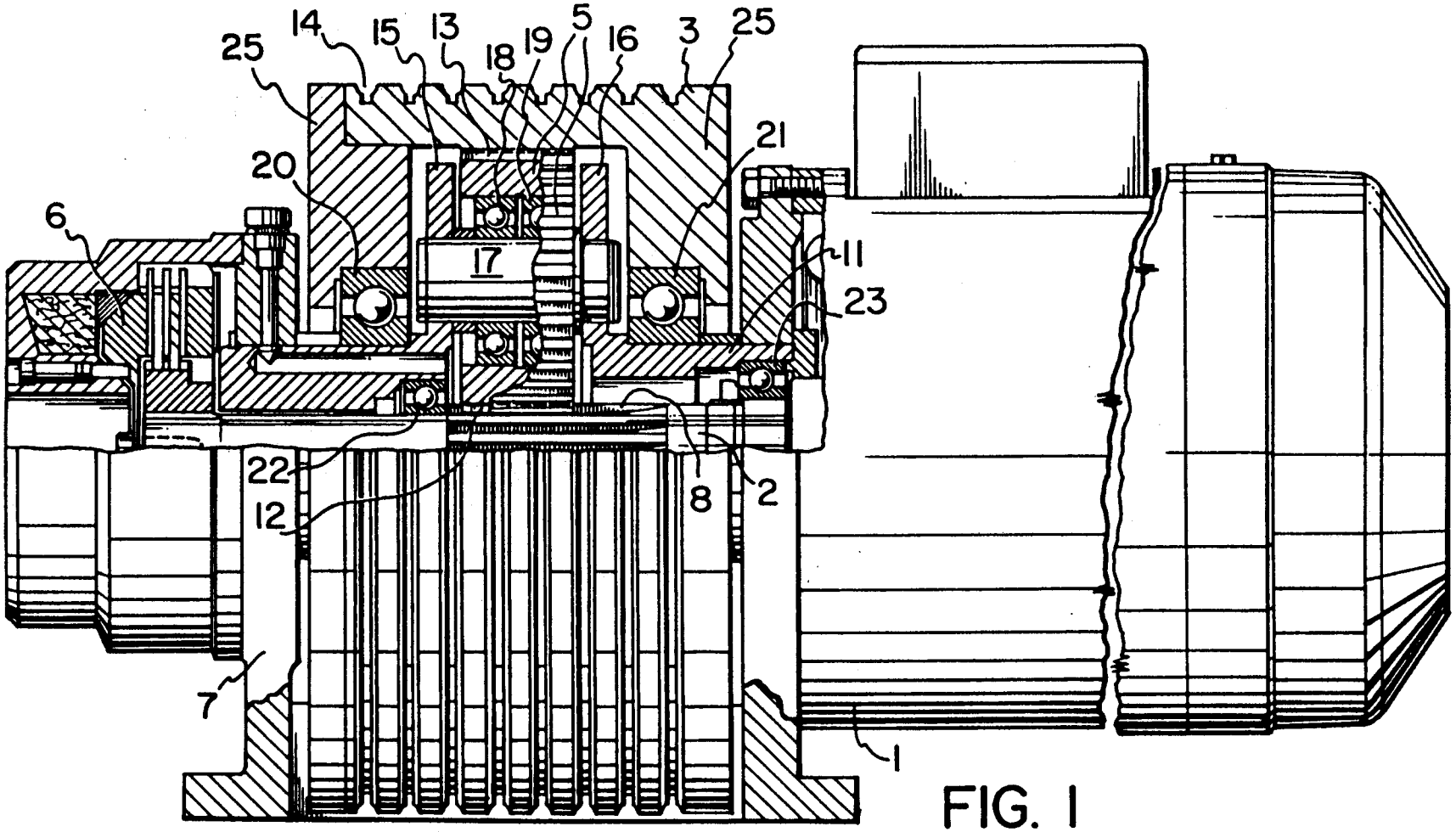
FIG. 1 is a side view of an embodiment of the machine of the invention in partial cross-section.

Referring to FIG. 1 a drive motor 1 powers a drive shaft 2. The drive shaft 2 goes through the hub of the traction sheave 3 and is coupled to a brake 6 on the other side of the sheave. The brake 6, preferably a dis brake, is afixed to the frame plate 7 of the elevator machine.

The drive shaft 2 is provided with a toothing 8 which is in mesh with the toothing 12 of a rotating intermediate gearwheel 5. The number of intermediate gearwheels 5 is not limited. The embodiment shown in FIG. 2 uses three intermediate gears, but other variants are possible. The intermediate gear 5 is in mesh with the traction sheave 3 via the toothing 13 provided on the interior surface of its rim. Preferably, helical gearing is used the helix angle and contact width of the teeth being selected such that the sum of the transverse contact ratio and the maximum contact ratio is as close as ensures that the total length of the pressure line and the engagement rigidity remain constant during engagement, resulting in an even tooth contact and a low noise level. When the motor 1 rotates the drive shaft 2, the latter in turn rotates the intermediate gears 5, which rotate the traction sheave 3. The rim of the traction sheave 3 is provided with a number of grooves 14, formed in a known manner and located side by side, for suspension ropes 4. The number of grooves 14 depends on the specific application and may vary greatly.

The drive shaft 2 is surrounded by a supporting axle 11 consisting of two tubular parts adjoining the intermediate gears 5, each of said tubular parts being provided with a flange 15, 16 at the end facing the intermediate gear 5. The flanges 15, 16 are interconnected by connecting members 24. The number of connecting members 24 may be, for example, three. The connecting members 24 are placed on the periphery of the flanges 15, 16 at an angular distance of 120° from each other, connecting the two flanges 15, 16 and thus making the supporting axle 11 rigid. The drive shaft 2 is supported inside the supporting axle 11 by two bearings, which preferably are placed at the points 22 and 23, these points being preferably located axially on either side of the drive shaft toothing 8.

A fixed axle 17 is provided between the flanges 15 and 16, the intermediate gear 5 being rotatably mounted on this axle means of bearings 18, 19.

The traction sheave 3 is rotatable mounted on the supporting axle 11 with bearing 20, 21. These are preferably located axially on either side of the intermediate gear 5.

Figure 2:
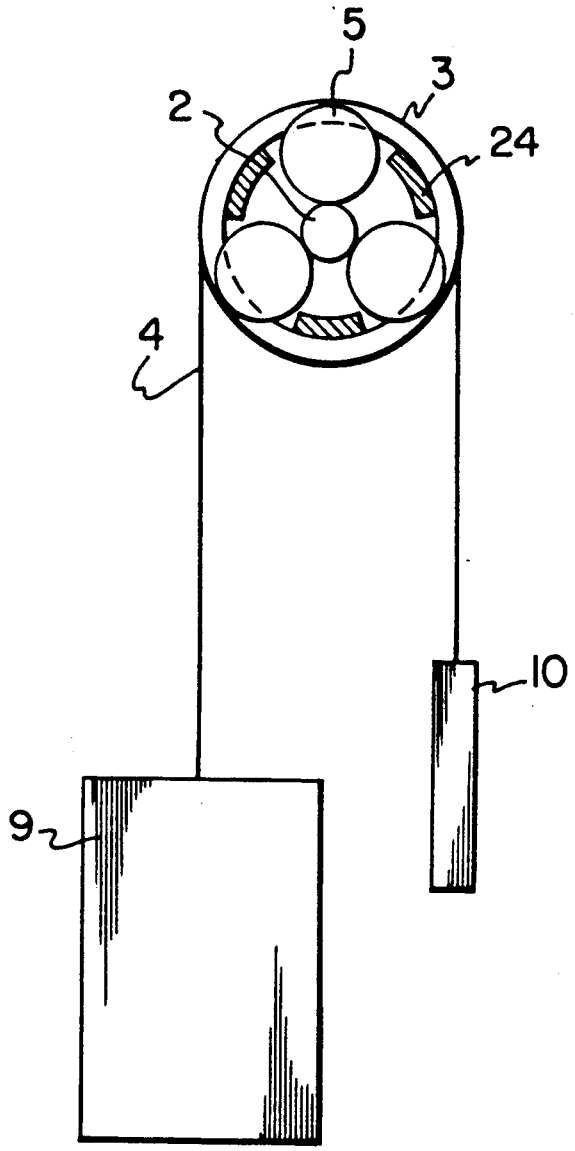
FIG. 2 is a diagram of the traction sheave, reduction gear, and an elevator car and counterweight suspended on the sheave, with ropes passing around the sheave.

Referring to FIG. 2, three intermediate gears 5 are depicted as being mounted inside the traction sheave 3 between the drive shaft 2 and the interior surface of the sheave rim. When the drive shaft 2 rotates, the intermediate gears 5 transmit the rotational power to the traction sheave 3, which in turn moves the elevator suspension ropes 4 with the aid of friction. The elevator car 9 is suspended at one end of the ropes 4 while the counterweight 10 is attached to the other end. Naturally the suspension system may include one or more diverting pulleys, which are not shown in this figure.

The side walls 25 of the traction sheave 3 may be made especially massive to insulate the noise generated by the tooth contacts between gears.

It will be obvious to a person skilled in the art that the invention is not restricted to the embodiments disclosed above, but may instead by varied within the scope of the following claims without departing from the spirit and scope of the invention. For example, the brake need not necessarily be constructed as shown in FIG. 1, but other types of brake can be used instead. However, if the brake is mounted on one end of the drive shaft 2 as shown, with the drive shaft 2 passing through the traction sheave 3, a compact construction is achieved.

I claim:

1. An elevator machine comprising:

a drive motor;

a drive shaft driven by said motor, said driveshaft being provided with gear teeth which are purposed to mesh with one or more intermediate gears;

said driveshaft being rotatably mounted in bearings located inside a fixed supporting axle;

said fixed supporting axle comprising one or more tubular parts and one or more flanges interconnected by one or more connecting members placed on the periphery of said flanges and rendering the supporting axle rigid, and wherein said one or more flanges support one or more intermediate gears between them, said one or more intermediate gears purposed to intermesh with said teeth of said driveshaft;

a traction sheave purposed to transmit motion of said drive shaft to an elevator car by means of cables;

said traction sheave being provided with internal toothing purposed to engage with said intermediate gears;

said intermediate gears comprising a gear assembly to reduce rotational speed of said motor for said traction sheave, said gear assembly being located inside said traction sheave;

said drive shaft passing through said traction sheave, said drive motor being coupled to one end of said drive shaft and a brake being mounted on the other end of said drive shaft on the opposite side of said traction sheave.

2. An elevator machine according to claim 1, further providing that said at least one of said intermediate gears is rotatably mounted with bearings on its axle.

3. An elevator machine according to claim 1, further providing that said brake is fixed to a frame plate of said elevator machine opposite said motor.

4. An elevator machine according to claim 1, further providing that side walls of said traction sheave are of a massive construction so as to dampen the noise generated by the gear assembly.

5. An elevator machine according to claim 1, wherein said fixed supporting axle comprises two tubular parts and two flanges interconnected by three connecting members placed on the periphery of said flanges at an angular distance of 120° from each other.

* * * * *